US010401061B2

(12) United States Patent
Burg et al.

(10) Patent No.: US 10,401,061 B2
(45) Date of Patent: Sep. 3, 2019

(54) HEAT PUMP NON-REVERSING VALVE ARRANGEMENT

(71) Applicant: Desert Aire Corp., Germantown, WI (US)

(72) Inventors: Craig Michael Burg, Sussex, WI (US); Jeremy Hogan, Greenfield, WI (US)

(73) Assignee: Desert Aire Corp., Germantown, WI (US)

( * ) Notice: Subject to any disclaimer, the term of this patent is extended or adjusted under 35 U.S.C. 154(b) by 344 days.

(21) Appl. No.: 14/602,790

(22) Filed: Jan. 22, 2015

(65) Prior Publication Data

US 2015/0204586 A1 Jul. 23, 2015

Related U.S. Application Data

(60) Provisional application No. 61/930,199, filed on Jan. 22, 2014.

(51) Int. Cl.

| | |
|---|---|
| ***F25B 6/04*** | (2006.01) |
| ***F25B 30/02*** | (2006.01) |
| ***F25B 41/04*** | (2006.01) |
| ***F25B 13/00*** | (2006.01) |
| ***F25B 49/02*** | (2006.01) |

(52) U.S. Cl.

CPC ..... *F25B 30/02* (2013.01); *F25B 6/04* (2013.01); *F25B 13/00* (2013.01); *F25B 41/04* (2013.01); *F25B 41/046* (2013.01); *F25B 49/02* (2013.01); *F25B 2313/021* (2013.01); *F25B 2339/047* (2013.01); *F25B 2400/0403* (2013.01); *F25B 2400/0409* (2013.01); *Y10T 29/49359* (2015.01)

(58) Field of Classification Search

CPC ..... F25B 30/02; F25B 41/04; F25B 41/046; F25B 6/04; F25B 49/02; F25B 13/00; F25B 2400/0409; F25B 2400/0403; F25B 2313/021; F25B 2339/047; F25B 2600/2501

USPC ..... 62/324.6, 117, 159, 196.4, 197, 226, 62/228.1, 238.6, 506

See application file for complete search history.

(56) References Cited

U.S. PATENT DOCUMENTS

| | | | | |
|---|---|---|---|---|
| 4,607,494 | A * | 8/1986 | Cipelletti | A23G 9/12 62/278 |
| 4,770,001 | A * | 9/1988 | Kittler | F24F 3/153 62/238.6 |
| 6,347,528 | B1 * | 2/2002 | Iritani | B60H 1/00357 62/323.1 |
| 2008/0184731 | A1 * | 8/2008 | Sienel | F25B 6/04 62/467 |
| 2010/0300135 | A1 * | 12/2010 | Otake | F24D 17/02 62/335 |
| 2012/0255319 | A1 * | 10/2012 | Itoh | F24F 3/1405 62/160 |
| 2013/0227973 | A1 * | 9/2013 | Kang | F25B 47/022 62/80 |

* cited by examiner

*Primary Examiner* — Joseph F Trpisovsky
(74) *Attorney, Agent, or Firm* — Boyle Fredrickson S.C.

(57) ABSTRACT

A heat pump system that is operable in heating and cooling modes and which maintains the direction of fluid flows through a primary heat exchanger during heating and cooling operations such that the respective fluids are directed in counter flow thermal directions during both heating and cooling operations.

16 Claims, 3 Drawing Sheets

HEAT PUMP NON-REVERSING VALVE ARRANGEMENT

CROSS REFERENCE TO RELATED APPLICATIONS

This application claims priority to U.S. Provisional Patent Application Ser. No. 61/930,199 titled "HEAT PUMP NON-REVERSING VALVE ARRANGEMENT" filed on Jan. 22, 2014 and the entire contents of which is expressly incorporated herein.

BACKGROUND OF THE INVENTION

The present invention relates generally to heating and cooling systems and more particularly to a heating and cooling system constructed to maintain a common fluid flow direction to achieve the desired thermal exchanges associated with operation of a heat pump during both heating and cooling operations.

FIGS. 2 and 3 are graphic representations of an exemplary heating and cooling system, or heat pump, and the components associated therewith. Referring to FIGS. 2 and 3, such systems commonly include a heat exchanger 10, that includes a first fluid loop 12 associated with a fluid whose temperature varies as a function of thermal interaction and a second fluid loop 14 associated with a working fluid. Such systems commonly include a compressor 16, an evaporator 18, a reheater 20, one or more valves 22, and a four-way or reversing valve 24 whose orientation is associated with the direction of fluid flow associated with the conduits to which it is engaged, or as shown in FIGS. 2 and 3, the direction of fluid flow associated with fluid loop 14 relative to hear exchanger 10.

In a common configuration, a refrigerant-air heat exchanger exposed to a process airstream increases or decreases the air temperature during separate modes of operation as associated with the demands associated with the application conditions. Referring to FIG. 2, when cooling or dehumidification of the process airstream is required, heat exchanger 18 is utilized as a refrigerant evaporator. An expansion device 22 located upstream of heat exchanger 18 reduces the pressure of the liquid refrigerant before it returns to heat exchanger 18 such that the refrigerant absorbs energy from the process airstream thereby decreasing the sensible and latent temperature of the airstream.

Referring to FIG. 3, during the alternate operating mode associated with increasing a process fluid temperature or flow heating activities, heat exchanger 18 is utilized as a refrigerant condenser. High temperature refrigerant vapor is introduced into heat exchanger 18 and condensed to liquid refrigerant as it is cooled by the process air. In either operating mode, heat exchanger 18 is exposed to working and refrigerant fluid flows but is operable as a refrigerant condenser or refrigerant evaporator in order to absorb or reject heat associated with fluid flow 14 as the situation or application may require. As shown in FIGS. 2 and 3, many such systems maintain a common direction associated with fluid flow 12 and reverse the direction of flow associated with the refrigerant fluid flow 14, as indicated by the opposite directional arrows associated with fluid flow 14 with respect to FIGS. 2 and 3, to achieve the alternate heating and cooling functions.

Redirection of refrigerant flow 14 is commonly achieved via operation of a valve or plurality of valves, such as reversing valve 24. The orientation of the one or more valves facilitates reversal of the direction of travel associated with fluid flow 14 through heat exchanger 10. Due to the fixed flow paths within heat exchanger 18, pressure differentials and velocities vary significantly as either warm vapor or cooled liquid associated with fluid flow 14 are directed therethough. Heat exchanger 18 must be designed and constructed to maintain desired fluid flow velocities to achieve a desired condition associated with the return of the refrigeration fluid when the system is utilized in the cooling mode. Such considerations increase the fluid pressure at compressor 16 when the system is operated in the heating mode as the pressure differential though heat exchanger 18 increases due to the higher volumetric flow rates at relatively similar mass flow rates.

Such concerns commonly result in the generation or utilization of larger heat exchangers for thermal counter flow configurations wherein the log mean temperature differentials of the heat exchange fluids are highest. Reversing the physical flow of refrigerant lessens the efficiency of the thermal exchange associated with operation of heat exchanger 18 as doing so creates a thermal parallel flow and lower log mean temperature differential. Such considerations commonly result in utilization of a fluid flow heat exchanger or heater that is associated with the working fluid flow and the airflow associated with the airstream associated with utilization of heat exchanger 20. Such a configuration increases the temperature of the process air when the system is operated in the cooling mode and is advantageous where latent cooling of the process air is required and limited or no detectable or sensible cooling is required. The secondary heat exchanger is commonly not utilized during operation of the system during the heating modes such that other components of the system must be configured to accommodate the flow parameters associated with the cooling demands.

Therefore, there is a need for heating and cooling systems that can achieve desired thermal exchanges associated with operation of a heat pump during both heating and cooling operations. There is also a need for a heating and cooling system constructed to maintain a common fluid flow direction when used for both heating and cooling operations

BRIEF DESCRIPTION OF THE INVENTION

The present invention is directed to a heat pump system that resolves one or more of the drawbacks discussed above. The heat pump system according to the present invention provides heating and cooling functionality without reversing the direction of flow through the heat exchanger associated with the working fluid flow. The system also utilizes the functionality of a second heater during both heating and cooling operations thereby providing more efficient utilization of the equipment associated with providing the heating and cooling operations.

Another aspect of the invention that is usable or combinable with one or more of the above aspects discloses a heat pump system that includes a primary heat exchanger having a first fluid path associated with a first fluid and a second fluid path associated with a second fluid. The heat exchanger is configured to accommodate thermal exchange between the flows associated with the first fluid path and the second fluid path. An evaporator and a compressor are fluidly connected to the second fluid path. A secondary heat exchanger is fluidly connected to the compressor and is fluidly associated with an air path and the second fluid path. A valve arrangement is associated with the second fluid path and is operable to maintain a common direction of flow of the second fluid during heating and cooling operations associated with the thermal exchange with the flow communicated via the air path.

Another aspect of the invention discloses a method of forming a fluid conditioning system that is operable in a cooling mode and a heating mode. The method includes connecting a primary heat exchanger to a first fluid stream and a second fluid stream that are fluidly isolated from one another but in thermal exchange with one another. A vapor compression system that includes a refrigerant compressor that is disposed between an evaporator and a secondary heat exchanger is connected to the system such that the second fluid stream is directed through the vapor compression system. The flow of the second fluid stream is controlled such that the second fluid stream is directed through the primary heat exchanger in a single flow direction during heating and cooling of the first fluid stream by the second fluid stream at the primary heat exchanger.

Another aspect of the invention discloses a heat pump system that includes a first heat exchanger that is configured to allow a thermal exchange between a first fluid flow and a second fluid flow. An evaporator is associated with the second fluid flow downstream of the first heat exchanger. A compressor is associated to the second fluid flow and connected downstream of the evaporator. A second heat exchanger is fluidly connected to the compressor and provides a thermal exchange between an air flow and the second fluid flow. A plurality of bypass passages are associated with at least two of the first heat exchanger, the evaporator, and the second heat exchanger such that second fluid flow maintains a common flow direction during both heating and cooling manipulations of the air flow.

These and other aspects, advantages, and features of the present invention will be better understood and appreciated from the drawings and the following description.

BRIEF DESCRIPTION OF THE DRAWING(S)

The drawings are for illustrative purposes only and the invention is not to be limited to the exemplary embodiment shown therein. In the drawings.

Figure 1:
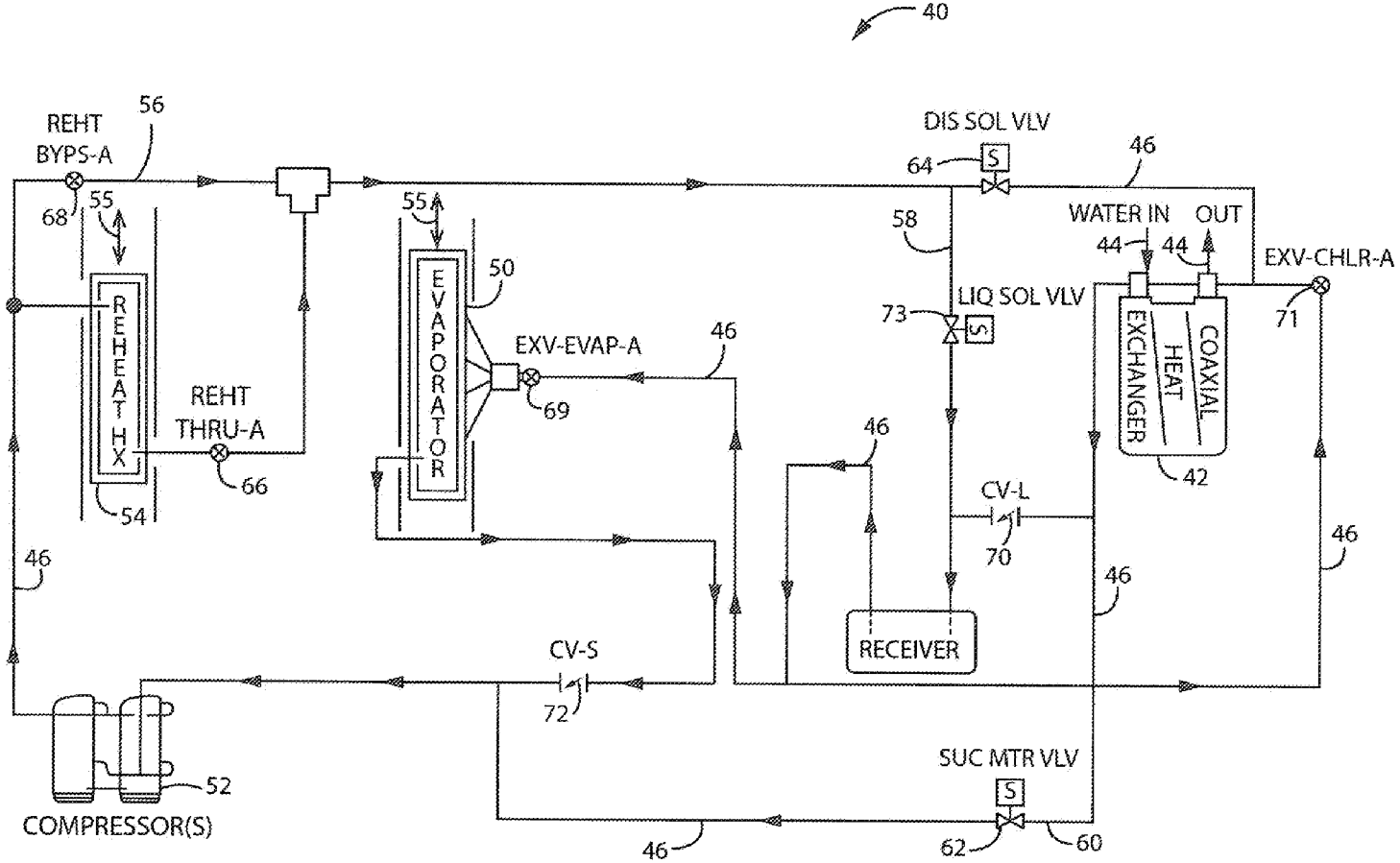
FIG. 1 shows a heat pump system according to the present invention.

In describing the preferred embodiments of the invention, which are illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF THE PREFERRED EMBODIMENTS

FIG. 1 shows a heat pump system 40 according to the present invention. System 40 includes a heat exchanger 42 associated with providing a thermal exchange between a first fluid flow, indicated by arrows 44, and a working or second fluid flow 46. The present invention contains valves in positions that create flows through the coils disposed in the airstream such that thermal counter flow occurs in both the heating mode and the cooling mode associated with operation of system 40 as described further below.

System 40 includes an evaporator 50 associated with fluid flow path 46 and positioned generally upstream of a compressor 52. A secondary heat exchanger 54 associated with an airflow 55 is disposed downstream of compressor 52. Fluid flow path 46 includes a first bypass 56 associated with accommodating a portion of the flow associated with flow path 46 being directed around air heat exchanger 54. System 40 includes a second bypass 58 oriented generally downstream of heat exchanger 54 and upstream of heat exchanger 42. A third bypass 60 fluidly connects heat exchanger 42 to compressor 52 in a manner that bypasses evaporator 50. System 40 includes a plurality of valves 62, 64, 66, 68, 69, 71, 73 and one or more flow limiters or backflow preventers 70, 72 associated with maintaining the desired directional flow associated with fluid path 46 and the operation of the various valves 62, 64, 66, 68, 69, 71, 73 associated therewith.

Figure 3:
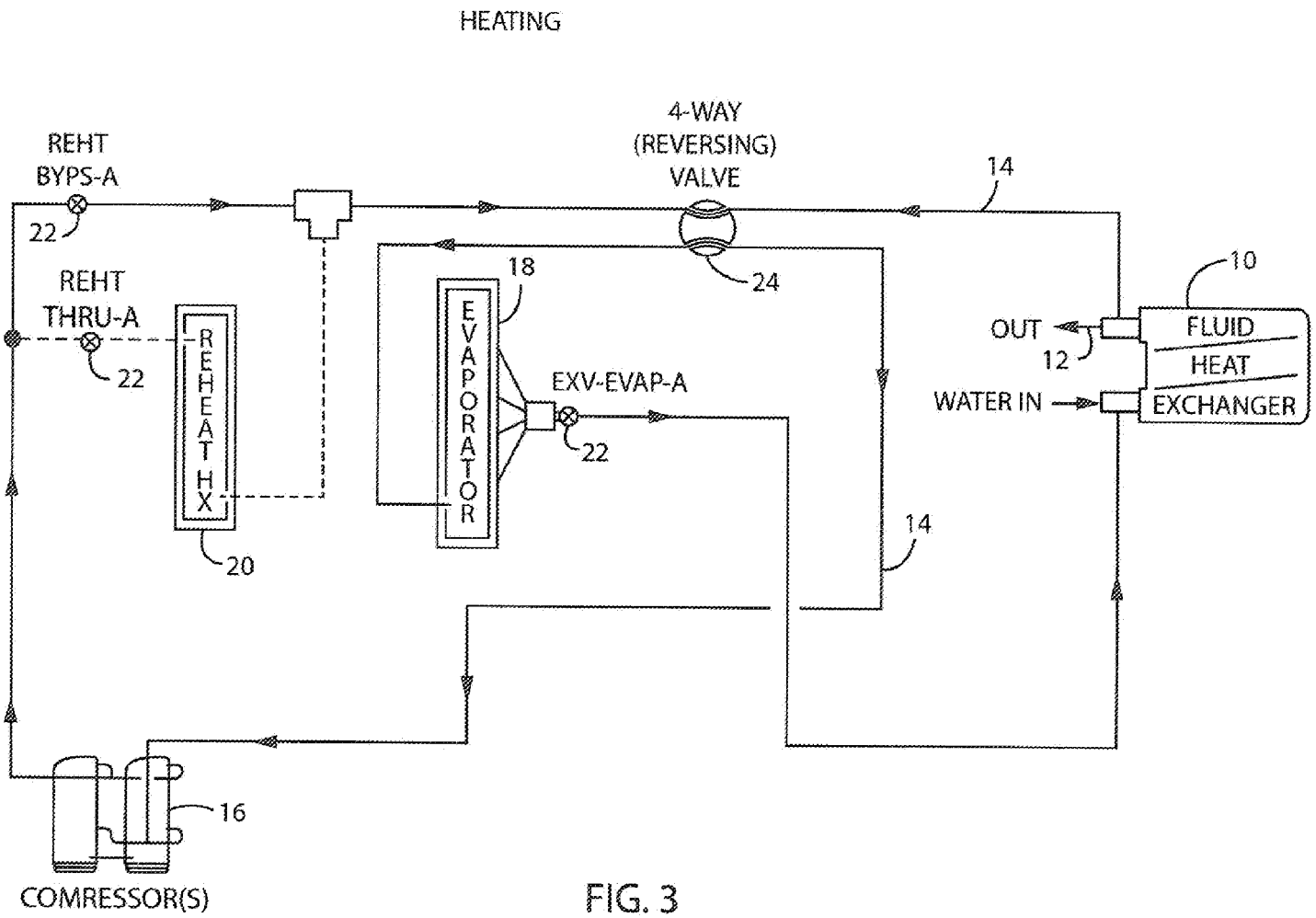
FIG. 3 is a view similar to FIG. 2 and indicates the direction of the fluid flow of the working fluid during heating operations.

During an air cooling process mode, the refrigerant flow through heat exchangers 42, 54 is as described above with respect to FIG. 3. On a call for heating of the process airstream, the unit also adjusts operation of valves 62, 64, 66, 68, 69, 71, 73 such that the second heat exchanger used for reheat during the cooling operation modes is used for heating the process airstream in the heating mode of operation. Direction of physical flow of the refrigerant remains the same through this heat exchanger, maintaining the thermal counter flow heat exchange in both modes of operation.

Figure 2:
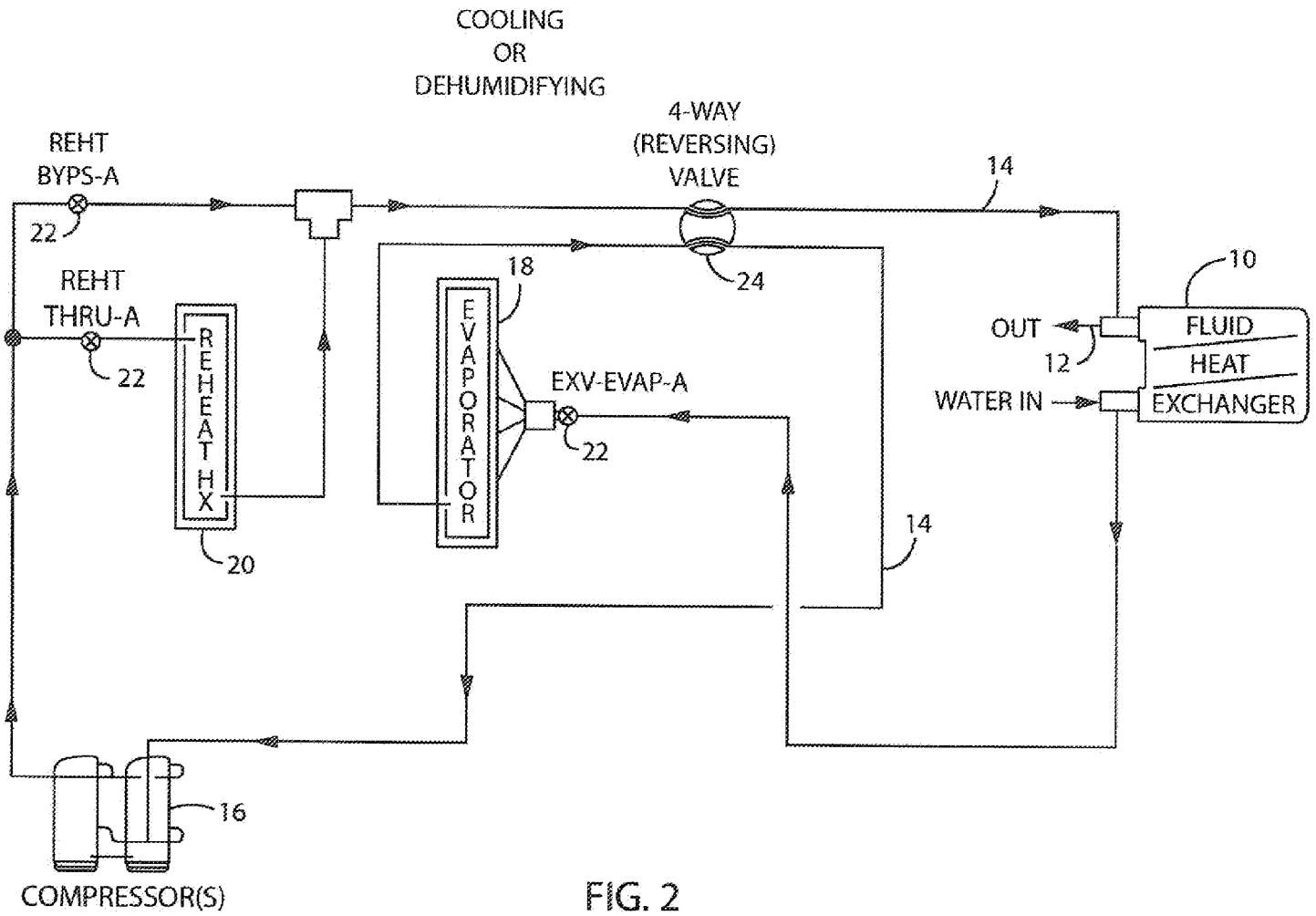
FIG. 2 shows a heat pump system that is usable in heating and cooling functions and indicates the direction of the fluid flow of the working fluid during cooling or dehumidifying operations.

Similarly, the heat exchanger 42 used to absorb or reject energy from a fluid loop 44 remains in thermal counter flow heat exchange. The refrigerant heat pump system is operable in both a heating and cooling mode. The heat exchanger present in the airstream functions as a refrigerant condenser. Water communicated to refrigerant heat exchanger 42 is utilized for either energy extraction or energy rejection. Unlike the system described above with respect to FIGS. 2 and 3, which reverses the direction of the refrigerant flow associated with the water to refrigerant heat exchange process and repurposes the air side heat exchanger, system 40 maintains counter flow heat exchanges associated with each of heat exchangers 42, 54 during both heating and cooling operating modes. System 40 avoids the less than optimal heat exchanger effectiveness and does not require the design compromises associated with providing heat exchangers that operate in parallel and counter flow conditions.

The component and valve arrangement of system 40 allows for thermal counter flow heat exchange in all modes of operation and the air side coils associated with heat exchanger 54 are not repurposed and can be optimized for use as refrigerant evaporators or condensers. Such a construction increases the heat exchanger effectiveness while allowing fluid flow velocities for oil return via working fluid velocities without compromise.

The air flow side evaporator, when operating, acts only as an evaporator and is also always in a thermal counter flow condition. In a similar manner; the air side condenser acts only as a condenser and is also in a more efficient thermal counter flow configuration. Although the unique valve and component arrangement presents distinct system benefits, combining the arrangement with variable capacity compressor technology also allows the water side heat exchanger to operate in a counter flow configuration regardless of its application as an evaporator or a condenser. As such, system 40 provides a heat pump system wherein all of the intended thermal exchanges associated with operation of the various heat exchangers occur in counter flow arrangements thereby providing a heat pump system having more effective heat transfer in each of a heating and cooling operating mode.

It is further appreciated that system 40 can include further operational enhancements with respect to the attributes disclosed above. For instance, heat exchanger 54 disposed in the process airflow, which operates as a condenser in both heating and cooling modes of operation, can be designed with internal passages optimized for the velocity and pressure drop of a much smaller range of volumetric and mass flow as the heat exchanger need not accommodate bidirectional or reverse of the direction of flow associated with the fluid passed therethrough. Such a consideration is an example of but one enhancement that can be attained with system 40.

Therefore, one embodiment of the invention includes a heat pump system having a primary heat exchanger with a first fluid path associated with a first fluid and a second fluid path associated with a second fluid. The heat exchanger is configured to accommodate thermal exchange between the flows associated with the first fluid path and the second fluid path. An evaporator and a compressor are fluidly connected to the second fluid path. A secondary heat exchanger is fluidly connected to the compressor and is fluidly associated with an air path and the second fluid path. A valve arrangement is associated with the second fluid path and is operable to maintain a common direction of flow of the second fluid during heating and cooling operations associated with the thermal exchange with the flow communicated via the air path.

Another embodiment of the invention includes a method of forming a fluid conditioning system that is operable in a cooling mode and a heating mode. The method includes connecting a primary heat exchanger to a first fluid stream and a second fluid stream that are fluidly isolated from one another but in thermal exchange with one another. A vapor compression system that includes a refrigerant compressor is disposed between an evaporator and a secondary heat exchanger and is connected to the system such that the second fluid stream is directed through the vapor compression system. The flow of the second fluid stream is controlled such that the second fluid stream is directed through the primary heat exchanger in a single flow direction during heating and cooling of the first fluid stream by the second fluid stream at the primary heat exchanger.

Another embodiment of the invention includes a heat pump system having a first heat exchanger and a second heat exchanger that are each associated with one common fluid flow. The first heat exchanger is configured to allow a thermal exchange between a first fluid flow and the common or a second fluid flow. An evaporator is associated with the second fluid flow downstream of the first heat exchanger. A compressor is associated to the second fluid flow and connected downstream of the evaporator. A second heat exchanger is fluidly connected to the compressor and provides a thermal exchange between an air flow and the second fluid flow. A plurality of bypass passages are associated with at least two of the first heat exchanger, the evaporator, and the second heat exchanger such that second fluid flow maintains a common flow direction during both heating and cooling manipulations of the air flow. Preferably, the thermal exchange associated with each of the first and second heat exchangers are in respective counter flow directions.

The present invention has been described in terms of the preferred embodiments, and it is recognized that equivalents, alternatives, and modifications, aside from those expressly stated, are possible and within the scope of the appending claims. It is further appreciated that although various embodiments of the proposed systems are disclosed herein, that various features and/or aspects of the various embodiments are combinable and/or usable together.

What is claimed is:

1. A heat pump system providing a heating mode heating an airflow at one time and a cooling mode cooling the airflow at another time, comprising:

a primary heat exchanger having a first fluid path associated with a first fluid and a second fluid path associated with a second fluid, the first fluid path and the second fluid path allowing a counter flow thermal exchange between the first fluid and the second fluid during each of a discrete heating operation heating the airflow in the heating mode and a discrete cooling operation cooling the airflow in the cooling mode;

an evaporator fluidly connected to the second fluid path;

a compressor fluidly connected to the second fluid path;

a bypass passage between an outlet of the primary heat exchanger and an inlet of the compressor;

a secondary heat exchanger fluidly connected to the compressor, the secondary heat exchanger being fluidly associated with the airflow and the second fluid path, the secondary heat exchanger operating as a condenser in both the heating and cooling modes; and a valve arrangement associated with the second fluid path, the valve arrangement being operable to maintain a common direction of flow of the second fluid during each of the discrete heating operation heating the airflow and the discrete cooling operation cooling the airflow, the valve arrangement allowing the counter flow thermal exchange in all modes of operation, wherein the valve arrangement comprises a first valve between an inlet and an outlet of the bypass passage, a second valve disposed between the evaporator and both the primary heat exchanger and the inlet of the bypass passage, and a third valve disposed upstream of the compressor and between an outlet of the evaporator and the outlet of the bypass passage.

2. The heat pump system of claim 1 further comprising a bypass passage that bypasses the secondary heat exchanger.

3. The heat pump system of claim 2 further comprising at least one of a valve upstream of the secondary heat exchanger and a valve downstream of the secondary heat exchanger that is configured to manipulate a flow rate through the secondary heat exchanger.

4. The heat pump system of claim 1 wherein the flows of the first fluid and the second fluid through the primary heat exchanger are in thermal counter flow directions relative to one another and the airflow is in a thermal counter flow direction relative to the second fluid path through the secondary heat exchanger during both the discrete heating operation and the discrete cooling operation.

5. The heat pump system of claim 1 wherein the secondary heat exchanger operates as a condenser during both the heating mode and the cooling mode.

6. The heat pump system of claim 1 wherein the secondary heat exchanger is connected downstream of the compressor, the primary heat exchanger is connected downstream of the secondary heat exchanger, the evaporator is connected downstream of the primary heat exchanger and the compressor is connected downstream of the evaporator.

7. A method of forming a fluid conditioning system that is operable in a cooling mode cooling an airflow at a one time and a heating mode heating the airflow at another time, the method comprising:

connecting a primary heat exchanger to a first fluid stream and a second fluid stream that are fluidly isolated from one another and in counter flow thermal exchange with one another;

connecting a vapor compression system that includes a refrigerant compressor that is disposed between an evaporator and a secondary heat exchanger such that the second fluid stream is directed through the vapor compression system;

providing a bypass passage between the primary heat exchanger and the refrigerant compressor that allows at least a portion of the second fluid stream to bypass the evaporator;

controlling the flow of the second fluid stream with a valve arrangement such that the second fluid stream is directed through the primary heat exchanger in a single flow direction during the heating mode heating the airflow and during the cooling mode cooling the airflow, wherein the first fluid stream and the second fluid stream flow in counter flow directions relative to one another without reversal of the single flow direction in each of the heating mode and the cooling mode, the valve arrangement allowing the counter flow thermal exchange in the heating and cooling modes, wherein the valve arrangement comprises a first valve between an inlet and an outlet of the bypass passage, a second valve disposed between the evaporator and both the primary heat exchanger and the inlet of the bypass passage, and a third valve disposed upstream of the compressor and between an outlet of the evaporator and the outlet of the bypass passage; and connecting the airflow to the secondary heat exchanger in thermal exchange with the second fluid stream directed therethrough, wherein the airflow and the second fluid stream are in counter flow directions relative to one another during both the heating mode and the cooling mode.

8. The method of claim 7 further comprising providing a thermal exchange at the secondary heat exchanger during the heating mode and the cooling mode between the airflow and the second fluid stream.

9. The method of claim 7 further comprising allowing at least a portion of the second fluid stream that is output from the secondary heat exchanger to bypass the primary heat exchanger.

10. The method of claim 7 further comprising directing the first fluid stream and the second fluid stream in opposite directions through the primary heat exchanger.

11. The method of claim 7 further comprising operating the secondary heat exchanger as a condenser during both the heating mode and the cooling mode and connecting the secondary heat exchanger downstream of the compressor, the primary heat exchanger downstream of the secondary heat exchanger, the evaporator downstream of the primary heat exchanger and the compressor downstream of the evaporator.

12. A heat pump system providing a heating mode heating an airflow at one time and a cooling mode cooling the airflow at another time, comprising:

a first heat exchanger having a counter flow thermal exchange between a first fluid flow and a second fluid flow;

an evaporator associated with the second fluid flow;

a compressor associated to the second fluid flow and connected downstream of the evaporator;

a second heat exchanger fluidly connected to the compressor, the second heat exchanger providing a counter flow thermal exchange between the airflow and the second fluid flow; and a plurality of bypass passages associated with each of the first heat exchanger, the evaporator, and the second heat exchanger such that the second fluid flow maintains a common flow direction and the first heat exchanger and the second heat exchanger maintain the respective counter flow thermal exchange during each of a discrete resultant heating mode heating the airflow and a discrete resultant cooling mode cooling the airflow completely through the heat pump system, the bypass passage associated with the evaporator being a bypass passage between an outlet of the first heat exchanger and an inlet of the compressor; and a valve arrangement associated with the plurality of bypass passages and being operable to maintain the common flow direction and allowing the counter flow thermal exchange during the heating and cooling modes associated with the air flow, wherein the valve arrangement comprises a first valve between an inlet and an outlet of the bypass passage associated with the evaporator, a second valve disposed between the evaporator and both the primary heat exchanger and the inlet of the bypass passage associated with the evaporator, and a third valve disposed upstream of the compressor and between an outlet of the evaporator and the outlet of the bypass passage associated with the evaporator.

13. The heat pump system of claim 12 wherein each of the plurality of bypass passages includes a valve that is configured to manipulate a mass flow associated with the second fluid flow.

14. The heat pump system of claim 13 further comprising a controller configured to control operation of the valve arrangement.

15. The heat pump system of claim 12 wherein the compressor is further defined as a variable stage compressor.

16. The heat pump system of claim 12 wherein at least one of the plurality of bypass passages bypasses the evaporator by virtue of being directed back to one of the first heat exchanger and to the compressor.

* * * * *